US005884341A

United States Patent [19]

Boardman et al.

[11] Patent Number: 5,884,341

[45] **Date of Patent: *Mar. 23, 1999**

[54] FAMILY TOILET SEAT

[76] Inventors: Kathleen Boardman; Judy A. Heller-Howe, both of 7492 Hillside Rd., Baldwinsville, N.Y. 13027

[ * ] Notice: The terminal 25 months of this patent has been disclaimed.

[21] Appl. No.: 292,839

[22] Filed: Aug. 19, 1994

[51] Int. Cl.[6] ..... A47K 13/00

[52] U.S. Cl. ..... 4/235; 4/242.1; 4/DIG. 5

[58] Field of Search ..... 4/235, 239, 242.1, 4/DIG. 5

[56] References Cited

U.S. PATENT DOCUMENTS

| | | | |
|---|---|---|---|
| Re. 32,807 | 12/1988 | Adams | 4/235 |
| 195,514 | 9/1877 | Kutscher | 4/239 |
| D. 305,537 | 1/1990 | Ritzer | D23/311 |
| D. 306,899 | 3/1990 | Miller | D23/296 |
| D. 309,176 | 7/1990 | Sessions | D23/296 |
| D. 333,345 | 2/1993 | Strahan | D23/311 |
| 697,264 | 4/1902 | Miles | 4/239 |
| 812,480 | 2/1906 | Bryant et al. | 4/235 |
| 1,739,001 | 12/1929 | Justus | 4/235 |
| 1,990,869 | 2/1935 | Joyce | 4/235 |
| 2,461,160 | 2/1949 | Joyce | 4/235 |
| 3,340,546 | 9/1967 | Moore et al. | 4/239 |
| 3,341,867 | 9/1967 | Keen | 4/239 |
| 4,461,046 | 7/1984 | Adams | 4/235 |
| 5,182,818 | 2/1993 | Nawoj | 4/235 |

FOREIGN PATENT DOCUMENTS

| | | | |
|---|---|---|---|
| 0141270 | 4/1920 | United Kingdom | 4/235 |
| 0593882 | 10/1947 | United Kingdom | 4/239 |

*Primary Examiner*—Robert M. Fetsuga

[57] ABSTRACT

A multiple toilet seat assembly which consists of an adult seat and a child seat with the child seat being formed in an adult seat lid. The child seat has a splash shield as well as a lid that is attached by a vertical pivot enabling the child seat lid to pivot parallel to the adult seat lid. The adult seat lid has a pair of slots and the child seat lid has a stop engageable with the slots to define fully open and fully closed positions of the child seat lid.

3 Claims, 4 Drawing Sheets

FAMILY TOILET SEAT

BACKGROUND

1. Field of Invention

The field of invention relates to commode apparatus and more particularly pertains to an improved child commode seat wherein the same is used for both adults and small children.

2. Description of Prior Art

Various commode seat constructions are utilized in prior art for use with children, such as exemplified in U.S. Pat. Nos. 4,461,046 and RE 32,807 to Adams (1984 & 1988) wherein a multiple toilet seat assembly of the type that permits the selective use of an appropriate sized opening for the selective use by a particular individual. Having a lid or cover, a child seat and an adult lid, with multiple splash shields. Both U.S. Pat. Nos. 4,461,046 and RE 322,807 require multiple toilet seats and multiple hinges making this toilet seat costly to manufacture and costly to the consumer. Due to the design of each seating component having an extended lip portion designed to protrude into the lower opening to prevent lateral movement in the seats when in the in-use or operative position would also add considerable amount of labor and materials at the time of manufacture. Also, the needed expense of having to purchase additional bumpers for the toilet seat would add an additional cost to this family toilet seat.

U.S. design 305,357 to Ritzer (1991) wherein multiple toilet seat assembly is used without the use a splash shield, thus permitting liquid to come in contact with the adult commode seat. This toilet seat assembly also utilizes two separate seats and a lid.

U.S. Pat. No. 5,182,818 to Nawoj (1993) wherein a child seat insert apparatus consisting of a central tubular conduit projecting down from the seat outer edge, comprising of an "S" shaped interior cavity splash shield with several mesh antisplash sock coverings to cover the splash shield. The need for the tubular conduit projecting down from the seat would increase the amount of material needed for manufacturing the child commode seat apparatus, thus increasing the cost to the public. The need for the mesh antisplash sock coverings for the splash shield would cause an unsanitary condition in use as well as in replacing the sock covering.

U.S. design 309,176 to Sessions (1990) wherein a multiple toilet seat assembly is used with the use of a small splash shield. The manufacture of the multiple seat apparatus would be costly to manufacture and costly to the consumer.

U.S. design 333,345 to Strahan (1993) wherein a combination toilet seat does not provide a splash shield and the child's seat does not adequately cover the commode, thus enabling the child's legs to come into contact with the top rim of the commode. Also, the adult seat straddles the child seat in the rear, thus weakening the adult seat structure.

U.S. design 306,899 to Miller (1990) wherein a multiple toilet seat assembly is used with the use of a small splash shield with the small seat nestled inside the open cover. This design uses two toilet seats and a lid, as well as a special hinge assembly which would increase the cost and resale to the consumer.

As such, it may be apparent that there continues to be a need for a new and improved family toilet seat as set forth by the instant invention which addresses the problem of ease of use, cost of manufacture as well as the effectiveness in construction in the proper orientation of a child in the use of a toilet structure and in this respect, the present invention substantially fulfills the needs for the adult as well as the child.

OBJECTS AND ADVANTAGES

In view of the foregoing disadvantages inherent in the known types of commode apparatus now present in the prior art, several objects and advantages of the present invention are:

(a) a child commode seat that is formed utilizing the adult commode lid, with the child's seat having its own swivel cover which will provide ease of access to the child.

(b) the child's seat is positioned so that the child will fit comfortably and securely on the seat.

(c) the child's seat also has an attached molded splash shield to enhance deflection of fluid spray relative to the shield.

(d) another object of our invention is to provide a family toilet seat unit which is inexpensive to manufacture with regard to both materials and labor, and which accordingly is then susceptible to low prices for sale to the consumer, durable in construction and efficient in operation.

(e) still another object of our invention is a multiple toilet seat unit having a child's toilet seat incorporated therein and being as essentially concealed when not in use.

Further objects and advantages of our invention will become apparent from a consideration of the drawings and ensuing description thereof.

DRAWING FIGURES

REFERENCE NUMERALS IN DRAWINGS

| | |
|---|---|
| 10 adult seat | 12 child seat/ad adult lid |
| 14 swivel lid | 16 molded splash shield |
| 18 conventional hinges | 20 pivot point |
| 22 finger indent | 24 molded stop |
| 26 slot radius-open | 28 slot radius-closed |

DESCRIPTION

A typical multiple toilet seat assembly includes a cover, an adult or conventional toilet seat and a child seat intermediate the cover and the adult seat and sharing a common hinge assembly at the seat section thereof.

Our invention differs from the typical multiple toilet seat assembly in that we have provided a smaller seat for the child incorporated in the adult lid, with the child's seat having its own swivel lid. The family toilet seat assembly, as illustrated, is preferable made from a molded plastic material as is common in the art.

Figure 1:
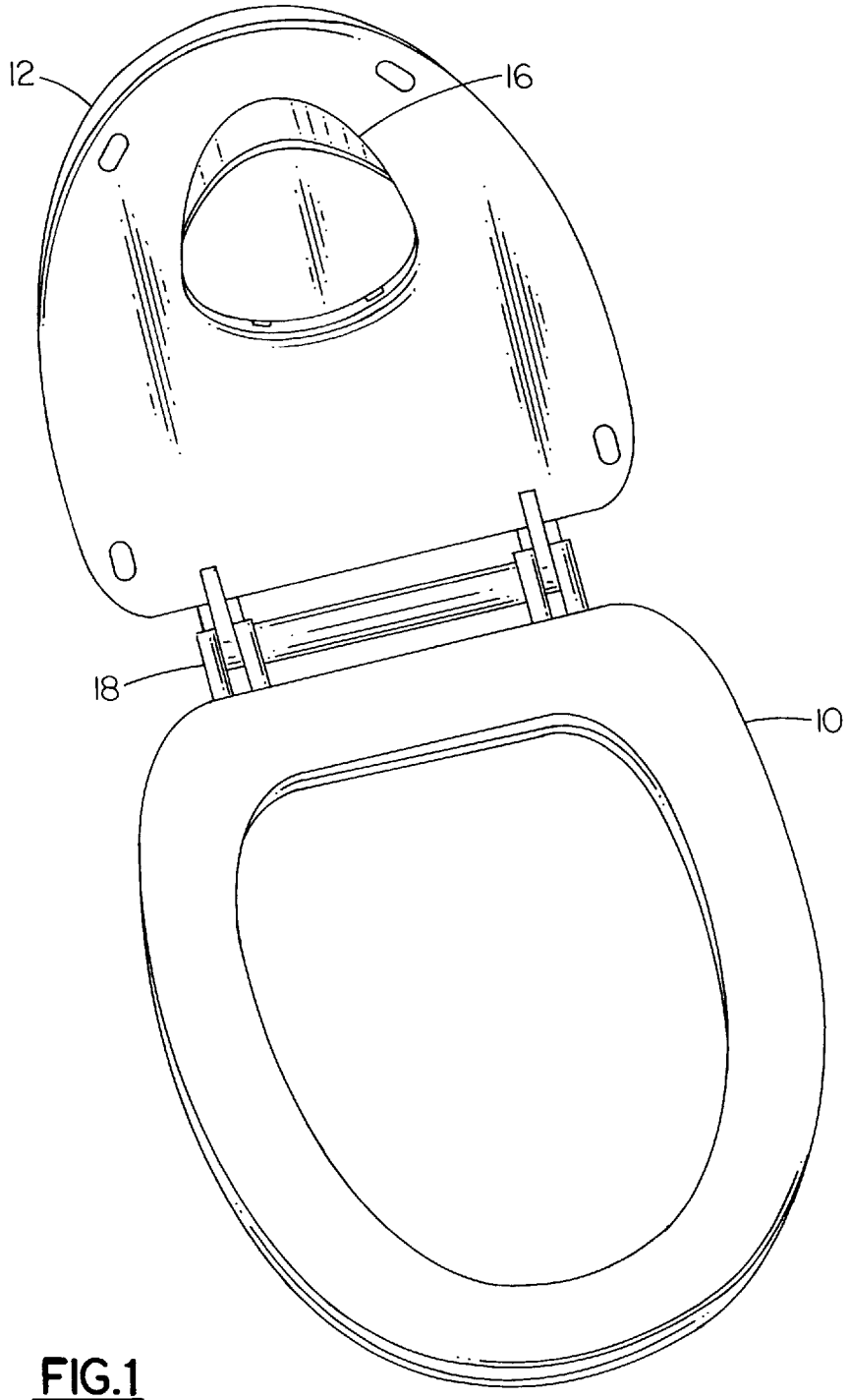
FIG. 1 shows a top plan view with lid open of combination adult and child seat cover showing our new design.

Referring in detail to the drawings, in accordance with usual practice, an adult seat 10 is secured to a toilet bowl (not shown) by means of a conventional hinge structure 18, as shown in FIG. 1, which also shows a child seat/adult lid 12 with a molded splash shield 16 being molded to the child seat/adult lid 12 at the time of manufacture.

Figure 2:
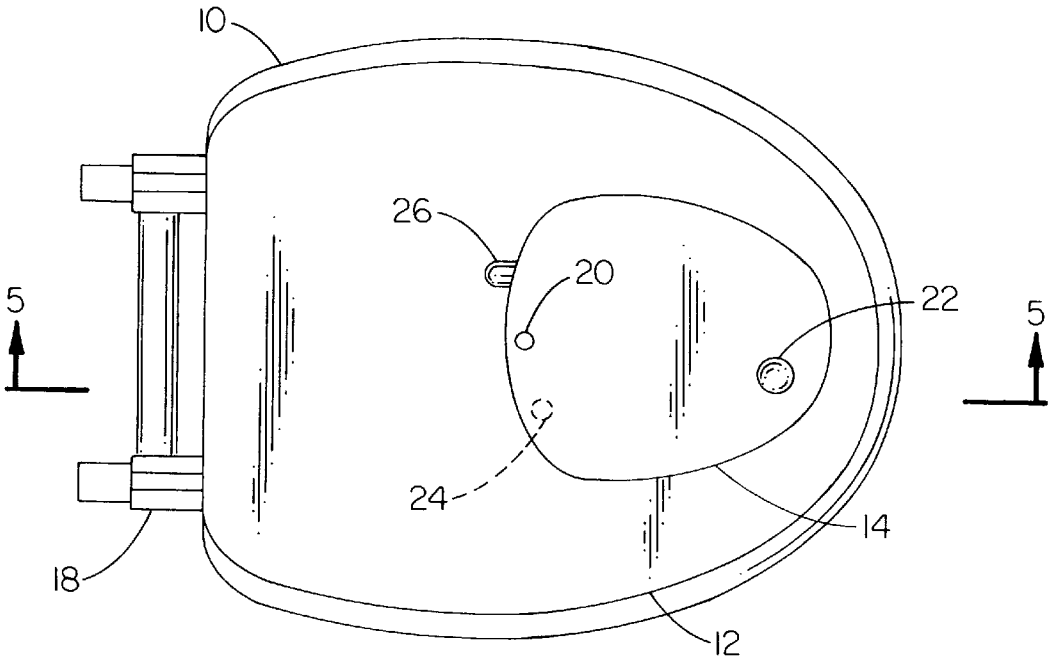
FIG. 2 shows a top plan view with both lids closed.
Figure 3:
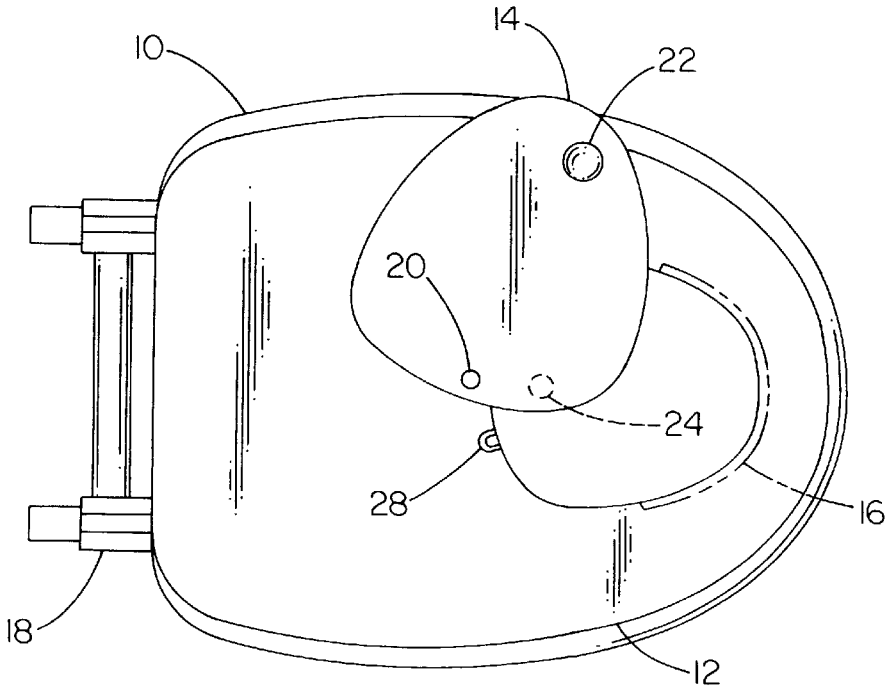
FIG. 3 shows a top plan view with swivel lid partially open.
Figure 4:
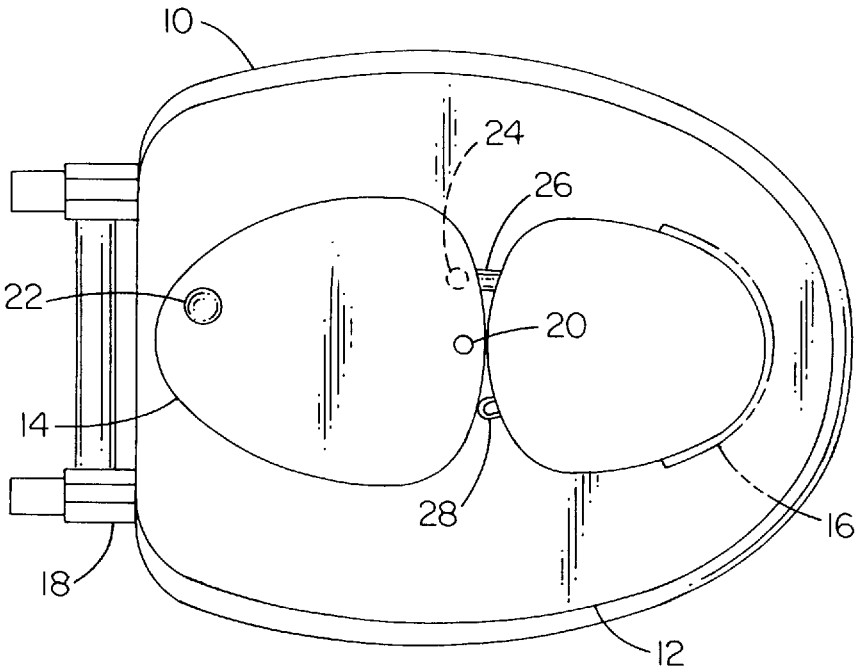
FIG. 4 shows a top plan view with the swivel lid completely open.

FIG. 2, 3 and 4 show the family toilet seat in the closed position while FIG. 2 shows a swivel lid 14 in the closed position. While swivel lid 14 is in the closed position, a slot 26 is visible. A molded stop 24 will glide in slot 26 as swivel lid 14 is open until reaching the stop point at the end of the slot 26. A finger indent 22 is used to aid in the opening of the swivel lid 14 The swivel lid 14 is held by a single pivoting point 20 at the rear of the seat assembly to facilitate it's movement. In addition, the molded stop 24 is molded on the underside of swivel lid 14 and glides in the slot 26 and a slot 28, until it reaches its stop point in either the opened or closed position.

FIG. 3 is an illustration of swivel lid 14 in the semi-open position showing slot 28. Molded stop 24 will glide in slot radius-open 26 when swivel lid 14 is in the open-in use position.

Figure 5:
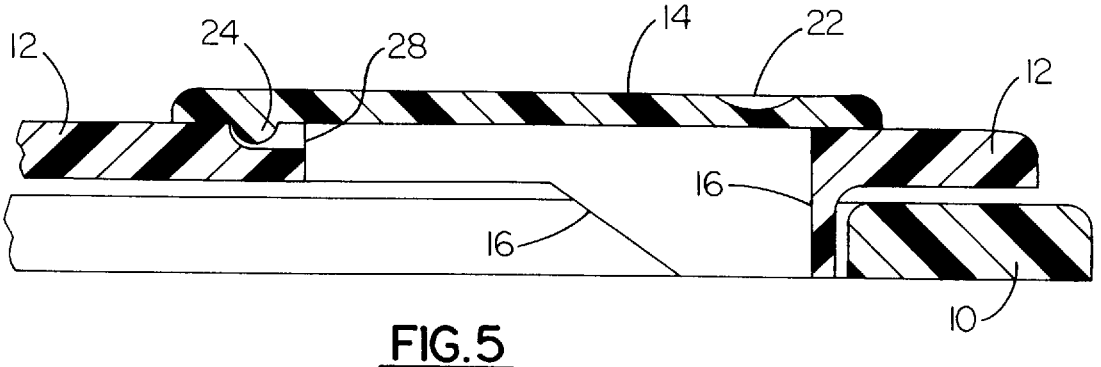
FIG. 5 shows a sectional view taken along 5—5 of FIG. 2.

FIG. 5 is a cross section of FIG. 2 with an adult seat 10, child seat/adult lid 12, swivel lid 14, molded splash shield 16, finger indent 22, molded stop 24 and slot 28.

Figure 6:
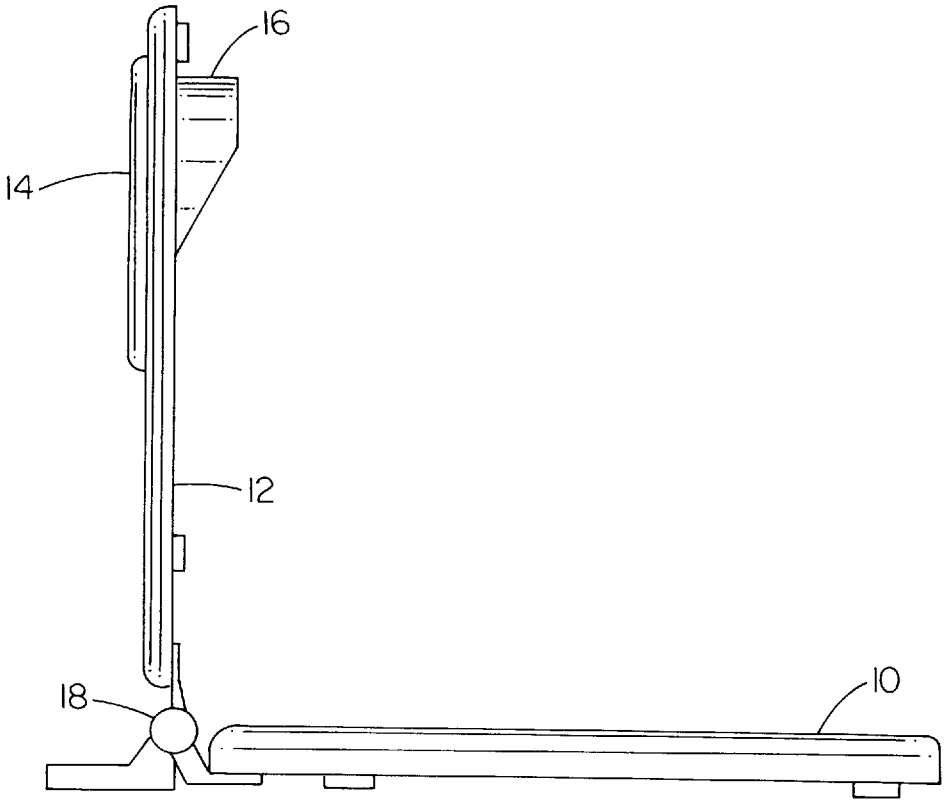
FIG. 6 shows the left elevational view of FIG. 1.

FIG. 6 illustrates the family toilet seat in the adult use position with the swivel lid 14 in the closed position.

Figure 7:
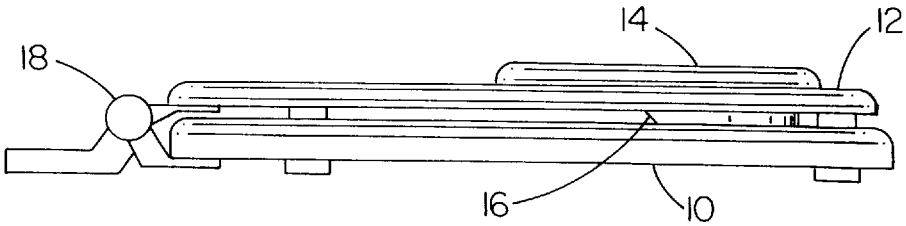
FIG. 7 shows the left side elevational view of FIG. 2.

FIG. 7 illustrates the family toilet seat in the closed position with the swivel lid 14 also in the closed position.

OPERATION—FIGS. 2, 3, 4, 6

The manor of using the family toilet seat for the adult is the standard way in which adults presently use the toilet seat as shown in FIG. 6. The child would utilize the family toilet seat by using finger indent 22 to open swivel lid 14 as shown in FIG. 3. When swivel lid 14 is fully open as in FIG. 4, the child's seat 12 would be ready for use. After use by the child, the child would utilize the finger indent 22 to close the swivel lid 14 as shown in FIG. 2.

SUMMARY, RAMIFICATIONS, AND SCOPE

Accordingly, the reader will see that the family toilet seat of this invention can be utilized by both the adult and the child, with the child being able to use the family toilet seat starting from a very early age. The size and placement of the child's seat in the adult lid is such that the child sits comfortably on the seat without fear of falling into the commode itself.

The swivel lid in which the child will open and close with ease, will make it convenient for the adult in the early toilet training stages of the child, as well as when the child is at an age when he/she will be able to use the family toilet seat without the aid of his/her guardian.

Although the description above contains many specifications, these should not be construed as limiting the scope of the invention but as merely providing illustration of some of the presently preferred embodiments of this invention.

Thus the scope of the invention should be determined by the appended claims and their legal equivalents.

We claim:

1. A multiple toilet seat assembly comprising:

an annularly-shaped seat member defining an outer periphery and an opening for use by an adult;

a first substantially flat lid member overlying said seat member, said lid member including an outer periphery substantially coextensive with said seat member outer periphery such that said seat member opening is completely covered by said lid member, said lid member further including an opening therethrough in registry with said seat member opening, said lid member opening being smaller than said seat member opening for use by a child;

hinge structure for pivotally mounting both said seat and lid members at respective rear portions thereof to a toilet bowl;

a second lid member overlying said first lid member and completely covering said lid member opening, said second lid member being pivotally mounted to said first lid member about an axis substantially perpendicular thereto, said second lid member including a stop protruding from an undersurface thereof adjacent said pivot axis; and said first lid member having a first slot formed therein adjacent said pivot axis, said first lid member further having a second slot formed therein adjacent said pivot axis and disposed on a side opposite said first slot, said stop engaging said slots to define fully open and fully closed positions of said second lid member with respect to said lid member opening.

2. A multiple toilet seat assembly as defined in claim 1 wherein the second opening comprises a downwardly extended contoured molded splash shield.

3. A multiple toilet seat assembly as defined in claim 1 wherein the second lid member has a finger-indent for ease in use by the child.

* * * * *